US006886454B1

(12) United States Patent
Torvi et al.

(10) Patent No.: US 6,886,454 B1
(45) Date of Patent: May 3, 2005

(54) CALENDERING ARRANGEMENT FOR A PAPER MACHINE

(75) Inventors: Timo Torvi, Järvenpää (FI); Matti Lares, Tuusula (FI)

(73) Assignee: Metso Paper, Inc., Helsinki (FI)

( * ) Notice: Subject to any disclaimer, the term of this patent is extended or adjusted under 35 U.S.C. 154(b) by 53 days.

(21) Appl. No.: 10/111,561

(22) PCT Filed: Nov. 1, 2000

(86) PCT No.: PCT/FI00/00947

§ 371 (c)(1),
(2), (4) Date: Sep. 3, 2002

(87) PCT Pub. No.: WO01/32982

PCT Pub. Date: May 10, 2001

Related U.S. Application Data

(63) Continuation of application No. PCT/FI00/00947, filed on Nov. 1, 2000.

(30) Foreign Application Priority Data

Nov. 5, 1999 (FI) ..... 19992393

(51) Int. Cl.[7] ..... B30B 13/00; B30B 3/04; D21F 11/00

(52) U.S. Cl. ..... 100/35; 100/161; 100/176; 162/205; 162/358.4

(58) Field of Search ..... 100/155 R, 159, 100/160, 161, 162 R, 163 R, 163 A, 167, 100/168, 169, 170, 173, 176, 35, 38; 162/263, 162/252, 272, 361, 205, 206, 358.4, 360.2, 162/360.3; 264/175

(56) References Cited

U.S. PATENT DOCUMENTS

| | | | | |
|---|---|---|---|---|
| 3,089,460 | A * | 5/1963 | Mahoney et al. | 118/60 |
| 4,375,188 | A * | 3/1983 | Leiviska | 100/162 R |
| 4,606,264 | A | 8/1986 | Agronin et al. | |
| 4,653,395 | A * | 3/1987 | Verkasalo | 100/38 |
| 4,670,102 | A | 6/1987 | Maurer et al. | |
| 5,137,678 | A | 8/1992 | Hess et al. | |
| 6,073,549 | A * | 6/2000 | Winheim et al. | 100/74 |
| 6,085,646 | A | 7/2000 | Lauterbach et al. | |

FOREIGN PATENT DOCUMENTS

| | | |
|---|---|---|
| GB | 2 241 968 A | 9/1991 |
| WO | WO 01/32982 A1 | 5/2001 |

* cited by examiner

*Primary Examiner*—Allen Ostrager
*Assistant Examiner*—Jimmy Nguyen
(74) *Attorney, Agent, or Firm*—Stiennon & Stiennon

(57) ABSTRACT

Higher-gloss paper grades, in particular paper grades with a Hunter gloss % above 40, are produced in an arrangement having pairs of calendering units (1, 3) disposed in the machine direction one after the other and apart from one another, which pairs are each formed of separate and different calendering units (1, 3) and in each of which the nip load in the latter calendering unit (3) is higher than the nip load in the preceding calendering unit (1). Advantageously, the calendering unit (1) placed first in the machine direction is an on-line long-nip calendering unit (1) and the calendering unit (3) placed after that in the machine direction is an on-line or off-line supercalender.

23 Claims, 1 Drawing Sheet

CALENDERING ARRANGEMENT FOR A PAPER MACHINE

CROSS REFERENCES TO RELATED APPLICATIONS

This application is a U.S. national stage application of International Application No. PCT/FI00/00947, filed Nov. 1, 2000, and claims priority on Finnish Application No. 19992393 filed Nov. 5, 1999, the disclosures of both of which applications are incorporated by reference herein.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The present invention relates to a calendering arrangement for a paper machine for producing higher-gloss paper grades, in particular paper grades with a Hunter gloss % above 40.

Calendering is a method by means of which the properties, in particular the thickness profile, smoothness, gloss and surface porosity of a web-like material, such as a paper web, are sought to be generally improved. In calendering the paper web is passed into a nip which is formed between rolls pressed against each other and in which the paper web is deformed by the action of temperature, moisture and nip load, in which connection the physical properties of the paper web can be affected by controlling the above-mentioned parameters and the time of action. The good physical properties attained by calendering lead to better print quality, thereby bringing a competitive advantage to the manufacturer of paper. Paper grades that contain a small amount of coating are environmentally more friendly than abundantly coated grades. The raw material costs of paper are formed roughly such that the less chemical pulp and the more mechanical pulp and fillers there are in paper, the cheaper the paper. The combustibility of uncoated paper grades is also considerably better as compared with coated grades, and thus it is possible to use paper waste as a source of energy and thereby to avoid the recycling costs which are today still rather high.

Long-nip calendering has been found in practice to be good for producing low-gloss paper grades, i.e. grades having a Hunter gloss % below 40, by calendering. When higher-gloss is required, the nip load in long-nip calendering is not sufficient to provide gloss. With ever-increasing running speeds, calendering is becoming a bottleneck in the papermaking process, and satisfactory quality is not achieved by today's machine calendering units. Some of the drawbacks of the present papermaking process are also that the loss of bulk increases when gloss is improved, in order to provide sufficient quality of gloss, it is necessary to use webs with an abundance of coating and/or to use off-line calendering, in particular multi-nip supercalendering and/or soft calendering, and investment costs and space requirement are high.

a. Machine calendering means here and hereafter calendering in a calendering unit in which nips are formed between non-resilient smooth-surface metal rolls placed one upon the other. The length of the nip in a machine calendering unit is dependent on the diameter of the rolls and on the thickness of the paper web that is being calendered, being typically very small, wherefore the nip load in the nips is relatively high.

b. Supercalendering, which provides in off-line operation in practice the best result in terms of quality, means above and hereafter calendering in a calendering unit in which nips are formed between a smooth-surface roll, such as a metal or chilled-surface roll, and a roll covered with a resilient coating, such as a paper or polymer roll, in which connection a remarkably wide nip is formed. The resilient-surface roll conforms to the contours of the surface of paper and presses the opposite side of paper evenly against the smooth-surface metal roll. Because of the resilient-surface roll, the calendering time is also longer, wherefore in order to assure adequate capacity, the paper machine must be equipped today even with three supercalenders. In one supercalender there are today typically 10 to 12 nips. For the purpose of treating both sides, the calender comprises a so-called reversing nip in which there are two resilient-surface rolls placed against each other. The linear load in the supercalender increases from the top nip to the bottom nip because of the force of gravity, but by using relieving of the rolls, this increase in load can be compensated for.

c. Soft calendering means above and hereafter calendering in a calendering unit in which nips are formed in a manner similar to that of a supercalender between a smooth-surface metal roll and a roll covered with a resilient coating, in which connection a nip of substantial width is formed. In a soft calender, each nip is formed between separate pairs of rolls, so that the nip load in the individual nips can be adjusted in each individual nip. The machine calenders of a paper machine can be replaced with soft calenders. In order to treat both sides of the web in the calender, the positions of the rolls in successive nips are exchanged so that both sides of the web are treated in the same way.

d. Long-nip calendering means above and hereafter calendering in a calendering unit in which a nip is formed between a roll provided with a resilient shell, the shell of said roll being made, for example, of polyurethane, and a press roll, shoe roll which is provided with inside loading shoes and which is made of metal. One long-nip concept marketed by Metso Paper, Inc. is called OptiDwell™, which includes two different long-nip calenders:

i. OptiDwell Shoe™ calender based on shoe press technology, ii. OptiDwell Belt™ calender based on roll/belt technology.

SUMMARY OF THE INVENTION

The primary aim of the present invention is to eliminate or at least minimize the weaknesses and drawbacks associated with the calendering today and to provide a new and inventive calendering arrangement for a paper machine, which arrangement would enable higher-gloss paper grades to be produced by calendering, in particular those having a Hunter gloss % above 40.

Thus, the invention is based on the new and inventive idea that, in a pair of calendering units formed of different and separate calendering units, the nip load in the latter calendering unit is higher than the nip load in the preceding calendering unit.

In accordance with an embodiment of the invention considered particularly advantageous, the arrangement comprises a combination in which there is disposed in the machine direction first at least one 1- or 2-nip on-line long-nip calendering unit, which advantageously comprises at least one calendering operation in an extended nip, and after that at least one other on-line or off-line calendering unit.

Based on trial run results of the arrangement according to the invention, it has been possible to find that it is advantageous to calender first by means of a long-nip on-line shoe calender and after that by means of another on-line or off-line calender, which is formed optionally either of at least one soft calendering unit or of at least one supercalendering unit. It is advantageous to have this very order because the web roughens on the side of a soft roll if the last calender is a long-nip shoe calender. When compared to a situation in which long-nip calendering producing a lower nip load is carried out after on-line calendering producing a higher nip load, it can be found that a gloss advantage of as much as 15 percentage units is achieved by means of the calendering arrangement according to the invention. Similarly, when the calendering arrangement according to the invention is compared with conventional on-line calendering, a gloss advantage of a few percentage units can be achieved by means of the calendering arrangement according to the invention.

With respect to the benefits of the invention, it may be further mentioned in particular that the thickness profiling of the web can be carried out in the second on-line or off-line calendering unit placed after the on-line long-nip calendering unit, and that the arrangement according to the invention provides improved properties of paper and their combinations and, as compared with the on-line and supercalenders in use today, reduced microroughness, higher gloss and a saving on bulk. With respect to the benefits of the invention, it may be further mentioned that, if there already exist supercalenders at the mill, long-nip calendering can be performed as on-line calendering and, after that, the web can be on-line or supercalendered in a normal manner in suitable process conditions.

BRIEF DESCRIPTION OF THE DRAWINGS

The invention and the other advantages attainable by it will be described in the following by way of example by means of some embodiments of the invention regarded as advantageous with reference to the accompanying drawing, in which FIG. 1 schematically shows a first advantageous embodiment of the invention, and FIG. 2 schematically shows a second advantageous embodiment of the invention.

DESCRIPTION OF THE PREFERRED EMBODIMENTS

Figure 1:
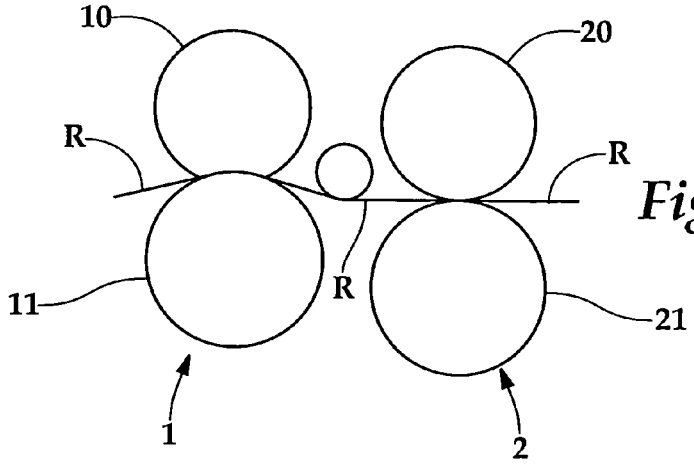

FIG. 1 shows a calendering arrangement according to a first embodiment of the invention considered advantageous for a paper machine for producing higher-gloss paper grades, in particular those with a Hunter gloss % above 40. The calendering arrangement of the embodiment shown in FIG. 1 is formed of one pair of calendering units, which comprises a combination of calendering units disposed in the machine direction one after the other and apart from one another, in which combination the nip load in the latter on-line or off-line calendering unit 2 is higher than the nip load in the preceding on-line calendering unit 1.

In accordance with the invention, with a view to producing a high-gloss paper grade, in the pair of calendering units:

the first on-line calendering unit 1 in the embodiment of FIG. 1 is a 1-nip long-nip calendering unit, which has an extended nip, which is formed between a rigid-shell metal roll 11, advantageously a thermo roll, and a resilient-shell shoe roll 10. The shoe roll 10 is provided with an internal glide shoe (not shown in the figure), which while supported on a frame structure inside the shoe roll 10, presses the shell of the shoe roll 10 or a roll/belt structure (not shown in the figure) placed around the shoe roll against the metal roll 11, which is the thermo roll of this kind of long-nip calendering unit, and the second on-line or off-line calendering unit 2 in the embodiment of FIG. 1 is a 1-nip soft calender with a nip formed between a roll 20 covered with a resilient coating and a metal roll 21, advantageously a thermo roll. In this connection, there is reason to emphasize that the soft calender usually comprises two nips which are formed between pairs of rolls placed apart from one another such that the positions of the metal roll 21 and the coated roll 20 have been inverted with respect to the web R in order to calender both sides of the web so as to be substantially identical.

Figure 2:
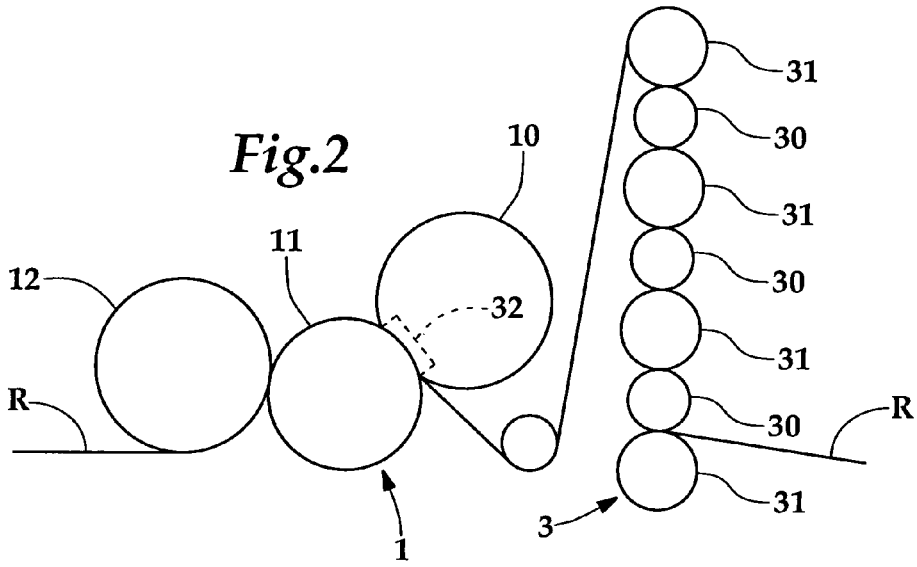

FIG. 2 shows a calendering arrangement according to another embodiment of the invention considered advantageous for a paper machine for producing higher-gloss paper grades, in particular those with a Hunter gloss % above 40. The calendering arrangement of the embodiment shown in FIG. 2 is formed of one pair of calendering units 1 and 3, which comprises a combination of different calendering units disposed in the machine direction one after the other and apart from one another, in which combination, similarly to the embodiment of FIG. 1, the nip load in the latter on-line or off-line calendering unit 3 is higher than the nip load in the preceding on-line calendering unit 1. In accordance with the invention, in order to prevent the paper from being roughened, it is advantageous that the nip load in the last extended nip of the on-line long-nip calendering unit 1 is lower than the nip load in the first nip of the supercalender 3 of the second on-line or off-line calendering unit placed after it in the machine direction.

Figure 3:
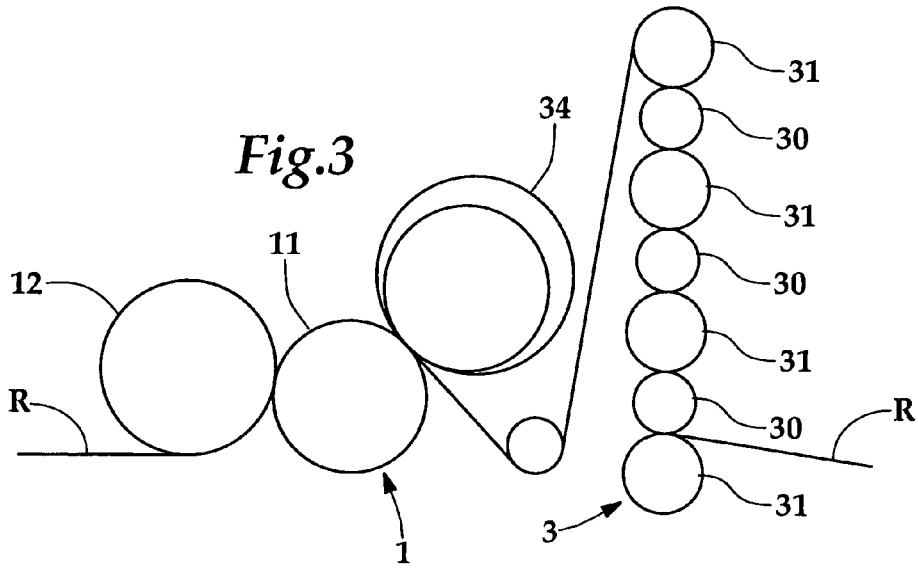
FIG. 3 schematically shows a third embodiment of the invention.

In accordance with the invention, with a view to producing a high-gloss paper grade, in the pair of calendering units:

the first on-line calendering unit 1 in the embodiment of FIG. 2 is a 2-nip calendering unit 1, in which in the machine direction, the first nip is a short nip which is formed between two metal rolls 11 and 12, the second nip is an extended nip which is formed between a rigid-shell metal roll 11, advantageously a thermo roll, and a resilient-shell shoe roll 10. The shoe roll 10 comprises an internal glide shoe 32, which while supported on a frame structure inside the shoe roll 10, presses the shell of the shoe roll 10 or a roll/belt structure 34 shown in FIG. 3) placed around the shoe roll against the metal roll 11, which is the thermo roll of this kind of long-nip calendering unit, and the second on-line or off-line calendering unit 2 in the embodiment of FIG. 2 is a multi-nip supercalender, in which each nip is formed between a resilient-surface roll 30, for example, a paper or polymer roll, and a hard-surface roll, such as a metal roll 31, advantageously a thermo roll.

It shall be emphasized that the order of the rolls may differ from the illustration in connection with FIGS. 1 and 2 above such that at least one of the thermo rolls 11, 21 is in an upper position. The rolls may also be placed around the thermo roll 11, 21, for example, in the order: a long-nip roll, a thermo roll and a soft roll; or a soft roll, a thermo roll and a long-nip roll.

Above, the invention has been described only by way of example by means of some of its embodiments considered advantageous. This is, of course, not intended to limit the invention and, as is clear to a person skilled in the art, many alternative solutions and variations are feasible within the inventive idea and its scope of protection defined in the accompanying claims.

What is claimed is:

1. A calender arrangement forming part of a papermaking machine comprising:

a paper web traveling through the calender arrangement, the traveling of the paper web defining a machine direction;

a first calendering unit, in the papermaking machine, the first calendering unit having a first long-nip formed using a calender based on shoe press technology or roll/belt technology, the first long-nip being formed between a rigid-shell metal roll and either a glide shoe pressing a resilient shell or a roll/belt structure; and a second calendering unit spaced apart in the machine direction from the first calendering unit, the second calendering unit having at least one on-line calender nip formed between a resilient-surface roll and a metal roll, wherein the paper web is under greater pressure in the second calendering unit nip than in the first long-nip, and wherein the paper web after the second calendering unit nip has a Hunter gloss % above 40.

2. The calender arrangement of claim 1 wherein the second calendering unit at least one on-line calender nip, is a first nip in a supercalender.

3. The calender arrangement of claim 1 wherein the second calendering unit at least one on-line calender nip is a first nip in a multi-nip supercalender.

4. The calender arrangement of claim 1 wherein the roll having a resilient surface is a paper roll or a polymer roll.

5. The calender arrangement of claim 1 wherein the paper web has a first side which engages first the rigid-shell metal roll and then the metal roll.

6. The calender arrangement of claim 1 wherein the second calendering unit metal roll is a thermo roll.

7. The calender arrangement of claim 1 wherein the rigid-shell metal roll is a thermo roll.

8. A calender arrangement forming part of a papermaking machine comprising:

a paper web traveling through the calender arrangement, the traveling of the paper web defining a machine direction;

a first calendering unit, in the papermaking machine, the first calendering unit having a first long-nip formed using a calender based on shoe press technology or roll/belt technology, the first long-nip formed between a rigid-shell metal roll and either a glide shoe pressing a resilient shell or a roll/belt structure; and a second calendering unit spaced apart in the machine direction from the first calender unit, the second calendering unit having at least one off-line calender nip formed between a resilient-surface roll and a metal roll, wherein the paper web is under greater pressure in the second calendering unit nip than in the first nip, and wherein the paper web after the second calendering unit nip has a Hunter gloss % above 40.

9. The calender arrangement of claim 8 wherein the second calendering unit at least one off-line calender nip is a first nip in a supercalender.

10. The calender arrangement of claim 8 wherein the second calendering unit at least one on-line calender nip is a first nip in a multi-nip supercalender.

11. The calender arrangement of claim 8 wherein the roll having a resilient-surface is a paper roll or a polymer roll.

12. The calender arrangement of claim 8 wherein the paper web has a first side which engages first the rigid-shell metal roll and then the second calendering unit metal roll.

13. The calender arrangement of claim 8 wherein the rigid-shell metal roll is a thermo roll.

14. The calender arrangement of claim 8 wherein the second calendering unit metal roll is a thermo roll.

15. A method of calendering a paper web comprising:

calendering the paper web in a first calender unit having a first long-nip formed using a calender based on shoe press technology or roll/belt technology, the first long-nip formed between a rigid-shell metal roll and either a glide shoe pressing a resilient shell or a roll/belt structure, wherein the calendering of the paper web in the first long-nip is carried out at a first selected pressure on a papermaking machine;

calendering the paper web in a second calender unit having a second nip formed between a resilient-surface roll and a metal roll, having a second selected pressure which is greater than the first selected pressure so that the paper web has a Hunter gloss % above 40 after the second calender unit; and wherein the first long nip is part of the first calender unit in a papermaking machine, and the second nip is part of the second calender unit separate from the first calender unit and wherein the second calendering unit is spaced apart from the first calender unit in a machine direction defined by a direction in which the web is traveling.

16. The method of claim 15 wherein the second calender unit is in an off-line calender.

17. The method of claim 15 wherein the second calender unit is in an on-line calender.

18. The method of claim 15 wherein the second nip in the second calender unit is a first nip in a supercalender.

19. The method of claim 18 wherein the roll having a resilient-surface is a paper roll or a polymer roll.

20. The method of claim 15 wherein the second nip in the second calender unit is a first nip in a multi-nip supercalender.

21. The method of claim 15 wherein the paper web has a first side which engages first the rigid-shell metal roll and then the metal roll.

22. The method of claim 15 wherein the rigid-shell metal roll is a thermo roll.

23. The method of claim 15 wherein the second calender unit second nip metal roll is a thermo roll.

* * * * *